US005323681A

United States Patent [19]

McDevitt, Jr.

[11] Patent Number: 5,323,681

[45] Date of Patent: Jun. 28, 1994

[54] SHAPING APPARATUS FOR AN EXPLOSIVE CHARGE

[75] Inventor: Henry S. McDevitt, Jr., Vilksburg, Miss.

[73] Assignee: The United States of America as represented by the Secretary of the Army, Washington, D.C.

[21] Appl. No.: 124,760

[22] Filed: Sep. 22, 1993

[51] Int. Cl.[5] ..... F42B 3/00

[52] U.S. Cl. ..... 86/20.12; 86/1.1; 264/3.1

[58] Field of Search ..... 86/1.1, 20.12; 264/3.1, 264/3.3

[56] References Cited

U.S. PATENT DOCUMENTS

| | | | |
|---|---|---|---|
| 2,942,298 | 6/1960 | Loedding | 264/3.1 |
| 3,034,393 | 5/1962 | Lieberman et al. | 264/3.1 |
| 3,653,792 | 4/1972 | Garrett | 425/1 |
| 3,907,947 | 9/1975 | Neuhaus et al. | 86/1.1 |
| 4,393,014 | 7/1983 | Ziegler | 264/3.1 |
| 4,450,768 | 5/1984 | Bell | 264/3.1 |
| 4,759,886 | 7/1988 | Daugherity | 264/3.1 |
| 4,920,079 | 4/1990 | Kaeser et al. | 264/3.1 |
| 4,987,818 | 1/1991 | Alford | 264/3.1 |

*Primary Examiner*—J. Woodrow Eldred

[57] ABSTRACT

The invention provides a shaping apparatus for an explosive charge to be used with an Explosively Formed Penetrator (EFP). The shaping apparatus comprises a nonmetal mold in the form of a frustum of a cone with a latch and hinge attached thereto. The mold is hand-packed with a plastic bonded explosive to form an explosive charge.

4 Claims, 2 Drawing Sheets

SHAPING APPARATUS FOR AN EXPLOSIVE CHARGE

STATEMENT OF GOVERNMENT INTEREST

The invention described and claimed herein may be manufactured and used by or for the Government of the United States of America for governmental purposes without the payment of royalties thereon or therefor.

FIELD OF THE INVENTION

The present invention relates to a design of an explosive charge shaping apparatus employed in an Explosively Formed Penetrator (EFP). More particularly, this invention provides a means by which an optimal amount of explosive energy can be directed into an EFP. In addition, this invention provides a means by which cyclonite (RDX) plastic explosives, such as Composition-4 (C-4) and PE-4, can be hand-packed into a shaping apparatus to obtain optimum performance from an EFP.

The Naval Surface Warfare Center has developed several EFPs to be used with C-4 explosives. The Navy's EFPs have extraordinary standoff capability, significantly improving standoff demolition munition technology (for such uses as bridge or bunker demolition). However, their designs are limited in performance due to poor projectile formation partially caused by nonuniform application of the explosive onto the rear portion of an EFP. The present invention discloses a design of an explosive charge shaping apparatus which provides uniform application of the explosive onto the EFP, resulting in improved EFP slug formation and flight characteristics. The present invention was formulated to work with the Navy 18-inch diameter EFP. However, the basic design could be readily used with any size EFP.

DESCRIPTION OF PRIOR ART

It is known that the U.S. Government, as represented by the Secretary of the Navy, has several patent applications pertaining to EFPs that are classified in class 102 and subclasses 24,746; 501,306; 307,309; and 310.

The Navy's original charge design requires that an exact weight of C-4 explosive be hand-packed to a uniform thickness and shaped to conform to the curvature of the rear portion of an EFP. This procedure for hand-packing the explosive to the rear portion of the EFP does not incorporate the use of a shaping apparatus to mold the explosive. Such a procedure, having no shaping apparatus, has several disadvantages. Namely, C-4 explosives come in blocks which are difficult to form without a shaping apparatus. Such a technique requires the user to have a set of scales available to weigh the explosive so that it can be applied with any degree of uniformity since no shaping apparatus is used. The primary disadvantage of not using a shaping apparatus is that it produces a nonuniform explosive charge causing irregular explosive fragments to occur within 75 feet from the point of initiation. In other words, the EFP begins to break apart after 75 feet of flight. This fragmentation of the EFP results in reduced terminal effectiveness and range limitations. Using the present invention to mold the explosive charge decreases EFP fragmentation, thus increasing its range limitations from 75 feet to about 300 feet.

SUMMARY OF THE INVENTION

It is the primary object of the invention to shape an explosive charge of an EFP in dimensions that improve slug formation, slug cohesion, and flight characteristics thus optimizing the explosive energy that can be directed into an EFP.

It is yet another object of this invention to provide a way to apply the requisite amount of explosive to an EFP without the use of scales to weigh the explosive.

It is an object of this invention to provide a means to easily extract the explosive charge from the mold after it has been formed.

The present invention meets the above mentioned needs using a shaping apparatus comprising a nonmetal mold, formed into a frustum of a cone, with dimensions having a wide base equalling about 18 inches, a narrow base equalling about 3 inches, and a height equalling about 4 inches. The plastic explosive is hand-packed into the mold so that the explosive takes on the frustoconical shape of the mold. A latch and a hinge are attached to the mold for easy and quick release of the molded explosive charge.

DETAILED DESCRIPTION OF THE PREFERRED EMBODIMENT

Figure 1:
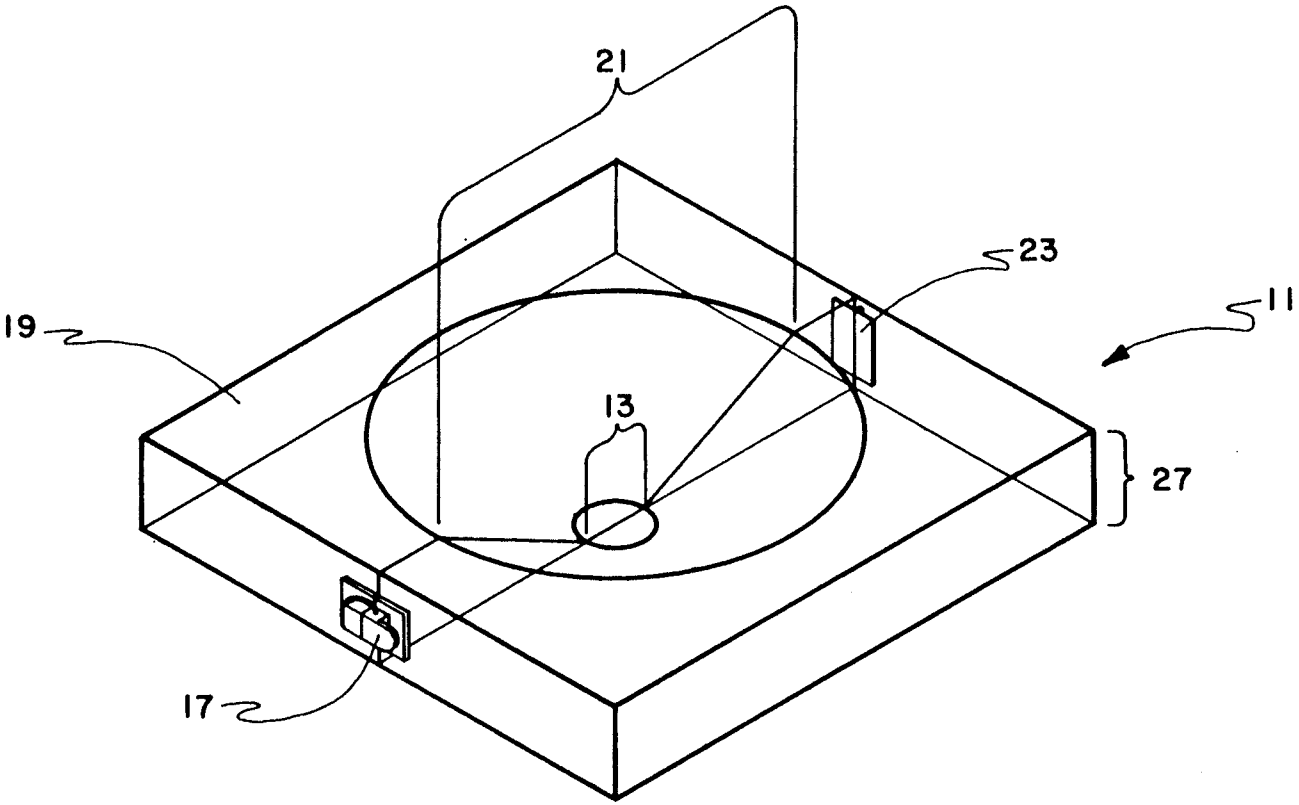
FIG. 1 is a plan view of the shaping apparatus for an explosive charge.

With reference to FIG. 1, there is shown a plan view of the preferred embodiment of the shaping apparatus 11. The shaping apparatus 11 is made of a nonmetal material, like plastic or wood but, preferably, plexiglass. The mold 19 is shaped like a frustum of a cone. The wide base 21 has a diameter of approximately eighteen inches. The narrow base 13 has a diameter of approximately three inches. The height of the mold 27 is approximately four inches. The latch 17 and the hinge 23 can be any type of latch or hinge, respectively, that attaches to the mold and allows the explosive charge to be easily removed.

Figure 2:
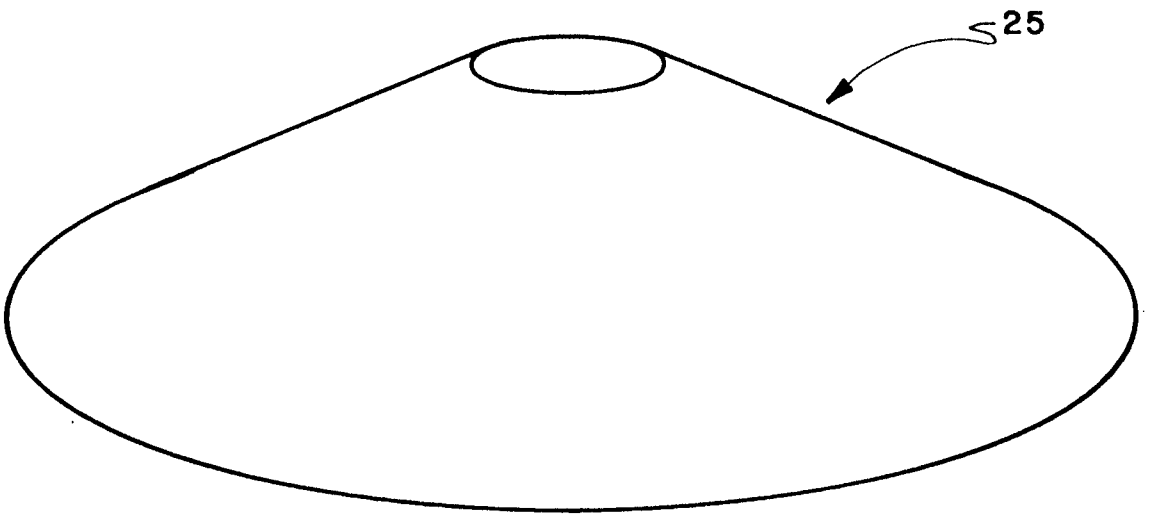
FIG. 2 is the molded shape of a plastic explosive charge.

With reference to FIG. 2, there is shown the molded explosive charge 25 after the explosive has been hand-packed in shaping apparatus 11. Prior to hand-packing, however, the shaping apparatus 11 should be greased to keep the charge from sticking to the mold. The shaping apparatus 11 is, preferably, hand-packed with any type of RDX based plastic explosive, such as C-4, PE-4, or PBX 113. Any high energy explosive may be used in an EFP but high energy plastic bonded explosives are preferred because they are easily molded to form a layer on the back of an EFP. After hand-packing, undo the latch so that the hinge will open and the explosive charge can be released.

The EFP has a metal plate that forms the projectile slug after initiation. The weight ratio of the plastic bonded explosive to this metal plate of the EFP is preferably from 1:1 to 4:1, and more preferably 2:1 to 4:1. It is critical that the molded plastic bonded explosive be of uniform thickness throughout to maximize the effect of using the mold. The more uniform the charge is molded, the better the slug cohesion and flight characteristics of the EFP will be improved.

Although this invention specifies precise dimensions for the mold, there are other dimensions that can work as effectively for different size EFPs. Determining the required volume of the mold and the diameter of the EFP used are the key to ascertaining the necessary dimensions for the mold. Using the appropriate dimensions eliminates the need for weighing the plastic explosive because, after hand-packing, the volume of the mold contains the requisite amount of explosive.

While in accordance with the provisions of the patent statute and the preferred forms and embodiments illustrated and described, it will be apparent to those of ordinary skill in the art that various changes and modifications may be made without deviating from the inventive concepts set forth above.

What is claimed is:

1. A shaping apparatus for an explosive charge, comprising:

a mold, wherein said mold forms a frustum of a cone with dimensions having (a) a wide base equalling about 18 inches;

(b) a narrow base equalling about 3 inches;

(c) a height equalling about 4 inches;

a latch positioned directly opposite a hinge allowing said explosive charge to be easily removed from said mold.

2. A shaping apparatus for an explosive charge, as defined in claim 1, wherein said mold is made of a nonmetal material.

3. A shaping apparatus as defined in claim 1, wherein said mold is hand-packed with a plastic bonded explosive having a weight ratio to an Explosively Formed Penetrator metal plate ranging from 1:1 to 4:1.

4. A shaping apparatus for an explosive charge, as defined in claim 2, wherein the nonmetal mold is made from the group consisting of plexiglass, plastic, and wood.

* * * * *